US006850134B2

(12) United States Patent
Lias et al.

(10) Patent No.: US 6,850,134 B2
(45) Date of Patent: Feb. 1, 2005

(54) CIRCUIT BREAKER OPERATING MECHANISM WITH A METAL CRADLE PIVOT

(75) Inventors: Edward E. Lias, Aliquippa, PA (US); Michael J. Whipple, Rochester, PA (US); Michael W. Nordmeyer, Glen Gardner, NJ (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/359,035

(22) Filed: Feb. 5, 2003

(65) Prior Publication Data

US 2004/0149556 A1 Aug. 5, 2004

(51) Int. Cl.[7] ..... H01H 9/00

(52) U.S. Cl. ..... 335/172; 335/185; 335/202

(58) Field of Search ..... 335/6–46, 147, 335/164–174, 185–202

(56) References Cited

U.S. PATENT DOCUMENTS 5,428,329 A * 6/1995 Grunert ..... 335/167
5,805,038 A 9/1998 Palmer et al.
6,255,924 B1 7/2001 Turner et al.

* cited by examiner

*Primary Examiner*—James R. Scott
(74) *Attorney, Agent, or Firm*—Martin J. Moran

(57) ABSTRACT

An operating mechanism assembly for a circuit breaker that includes a frame assembly, a metal pivot structure, and a trip device. The trip device has a cradle member structured to pivot about a pivot point and a trip assembly. The trip assembly is coupled to the frame assembly. The cradle member is pivotally disposed on the metal pivot structure.

12 Claims, 5 Drawing Sheets

CIRCUIT BREAKER OPERATING MECHANISM WITH A METAL CRADLE PIVOT

CROSS-REFERENCE TO RELATED APPLICATIONS

This application is related to commonly assigned, concurrently filed:

U.S. patent application Ser. No. 10/358,991, filed Feb. 2, 2003, entitled "Non-Conductive Barrier for Separating A Circuit Breaker Trip Spring and Cradle"; and U.S. patent application Ser. No. 10/359,036, filed Feb. 2, 2003, entitled "Self-Contained Mechanism on a Frame"; and U.S. patent application Ser. No. 10/359,006, filed Feb. 2, 2003, entitled "Circuit Breaker Including Magnetic Trip Mechanism".

BACKGROUND OF THE INVENTION

1. Field of the Invention

The present invention relates to circuit breakers and, more specifically, to an operating mechanism having pivoting cradle and a metal pivot structure upon which the cradle pivots.

2. Background Information

Circuit breakers having an operating mechanism and trip means, such as a thermal trip assembly and/or magnetic trip assembly, which are automatically releasable to effect tripping operations and manually resettable following tripping operations are known in the art. An example of such circuit breakers is disclosed in U.S. Pat. No. 5,805,038 which is assigned to the assignee of this application and which is incorporated by reference. Such circuit breakers, commonly referred to as "miniature circuit breakers," have been in use for many years and their design has been refined to provide an effective, reliable circuit breaker which can be easily and economically manufactured on a large scale. As such, the ease of manufacture of such circuit breakers is of importance.

Circuit breakers of this type include at least one set of separable contacts disposed within a non-conductive housing. Typically, there is a fixed contact attached to the housing and a movable contact coupled to an operating mechanism. The operating mechanism includes a movable handle that extends outside of the housing. The handle has essentially three stable positions: on, off, and tripped. These three positions tell the operator what condition the contacts are in when the handle is viewed. Thus, when the contacts are in a first, closed position, the handle is maintained in the on position. The operating mechanism may be actuated to move the contacts into a second, open position. From the first, closed position, once the trip means is automatically released so as to protect electrical circuitry from damage due to an overcurrent condition such as an overload or relatively high level short circuit, the contacts separate and the handle automatically moves to the tripped position which is located between the on position and the off position. The circuit breaker must then be reset, as is known in the art, by moving the handle beyond the off position to a reset position from which the handle returns to the off position when released. The circuit breaker may then be manually operated from the off to on position in order to return the contacts to the first, closed position and allow the circuit breaker to resume normal operation.

Movement of the contacts is accomplished by an operating mechanism. The operating mechanism typically includes components such as the previously mentioned handle, an operating arm, upon which the movable contact is disposed, and a trip device, such as the previously mentioned thermal trip assembly and/or magnetic trip assembly as well as a cradle. The cradle is coupled to a spring and disposed between the trip device and the operating arm. The components may further include a frame to which the other components are coupled. The operating mechanism is disposed within an operating mechanism cavity within the circuit breaker housing. In the prior art, selected components, such as the handle and the cradle, were mounted on, and structured to pivot about, protrusions within the operating mechanism cavity. Thus, the operating mechanism needed to be assembled within the operating mechanism cavity. This assembly procedure is time consuming as it must be performed within the enclosed operating mechanism cavity. Additionally, the operation of the operating mechanism, which is generally made of steel, would slowly degrade the housing as the components pivoted against the softer, typically plastic, housing material.

There is, therefore, a need for an operating mechanism for a circuit breaker which has components that do not pivot about the soft housing material.

There is a further need for an operating mechanism for a circuit breaker with a metal pivot structure about which the operating mechanism components, such as the cradle, may pivot.

SUMMARY OF THE INVENTION

These needs, and others, are met by the disclosed invention which provides a metal pivot structure upon which the cradle may pivot. Preferably, the metal structure is a shoulder incorporated into a self-contained, or unitary, operating mechanism. The unitary operating mechanism includes a generally planar frame assembly, a handle member, an operating arm and a trip device. The trip device includes a cradle member. The frame assembly includes a first pivot point and a second pivot point. The handle member is rotatably coupled to the first pivot point and the cradle member is rotatably coupled to the second pivot point. Preferably, the metal pivot structure is disposed at the second pivot point and is a shoulder coupled to the frame assembly. The cradle includes an opening that is structured to engage the shoulder, thereby creating the pivot.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the statement that two or more parts are "coupled" together shall mean that the part are joined together either directly or joined through one or more intermediate part. Further, as used herein, the statement that two or more parts are "attached" shall mean that the part are joined together directly.

Figure 1:
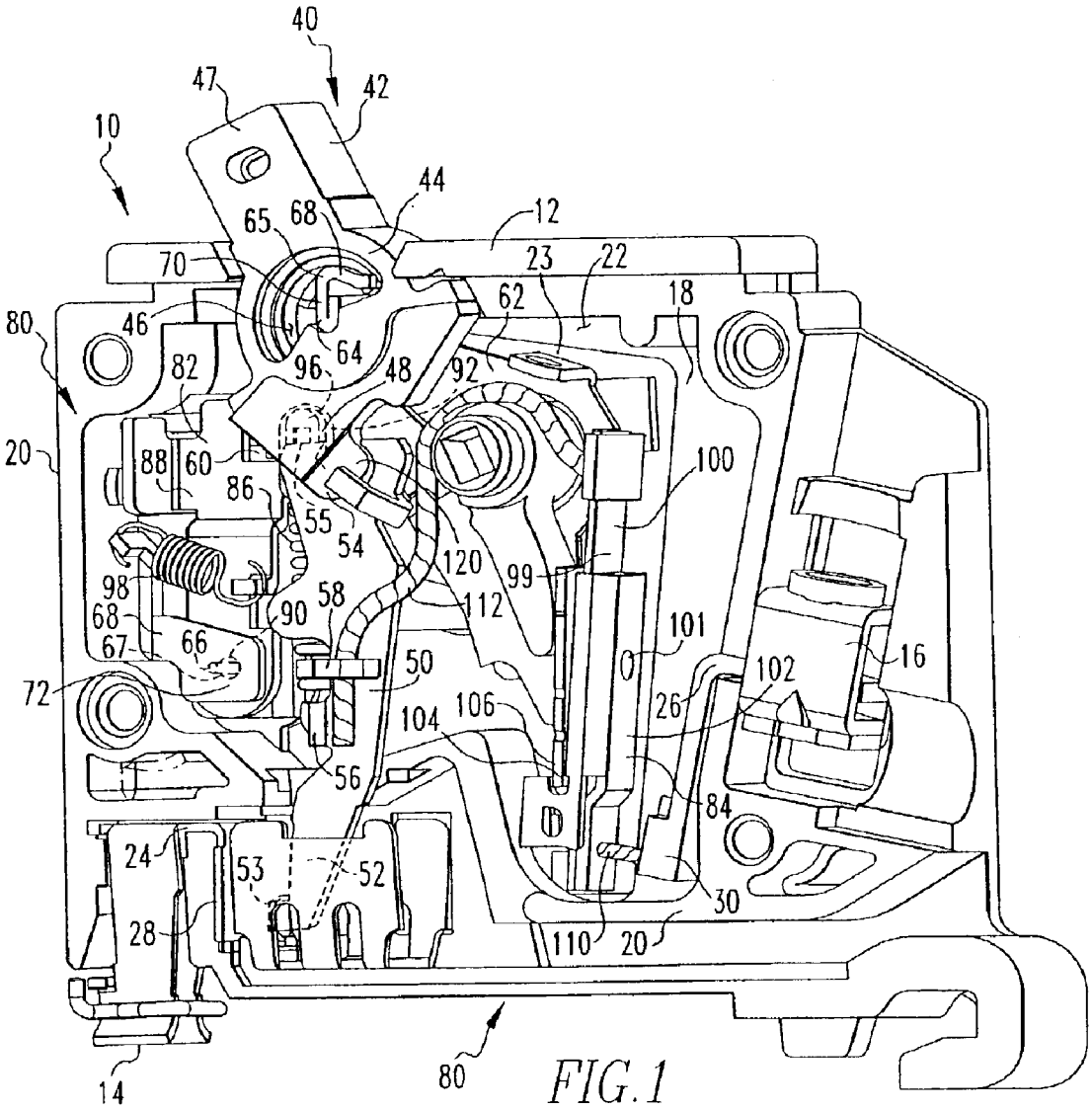
FIG. 1 is an isometric view of the unitary operating mechanism in a circuit breaker.

As shown in FIG. 1, a circuit breaker 10 includes a non-conductive housing 12, a first terminal conductor 14, a second terminal conductor 16 and a unitary operating mechanism assembly 40. The housing 12 includes a generally planar base wall 18 and generally perpendicular sidewalls 20 forming an operating mechanism cavity 22. The housing 12 further includes an insulating cover (not shown) that encloses the operating mechanism cavity 22. On the base wall 18 within the operating mechanism cavity 22 may be a recess 23 shaped to accommodate the frame assembly 60, described below. The first terminal conductor 14 and the second terminal conductor 16 are mounted in the housing at a location external to the operating mechanism cavity 22. The first terminal conductor 14 and the second terminal conductor 16 include conductive tabs, 24, 26 respectively, that extend through the sidewalls 20 into the operating mechanism cavity 22. The first terminal conductor tab 24 terminates in a fixed contact 28. The second terminal conductor tab terminates in a contact pad 30.

Figure 2:
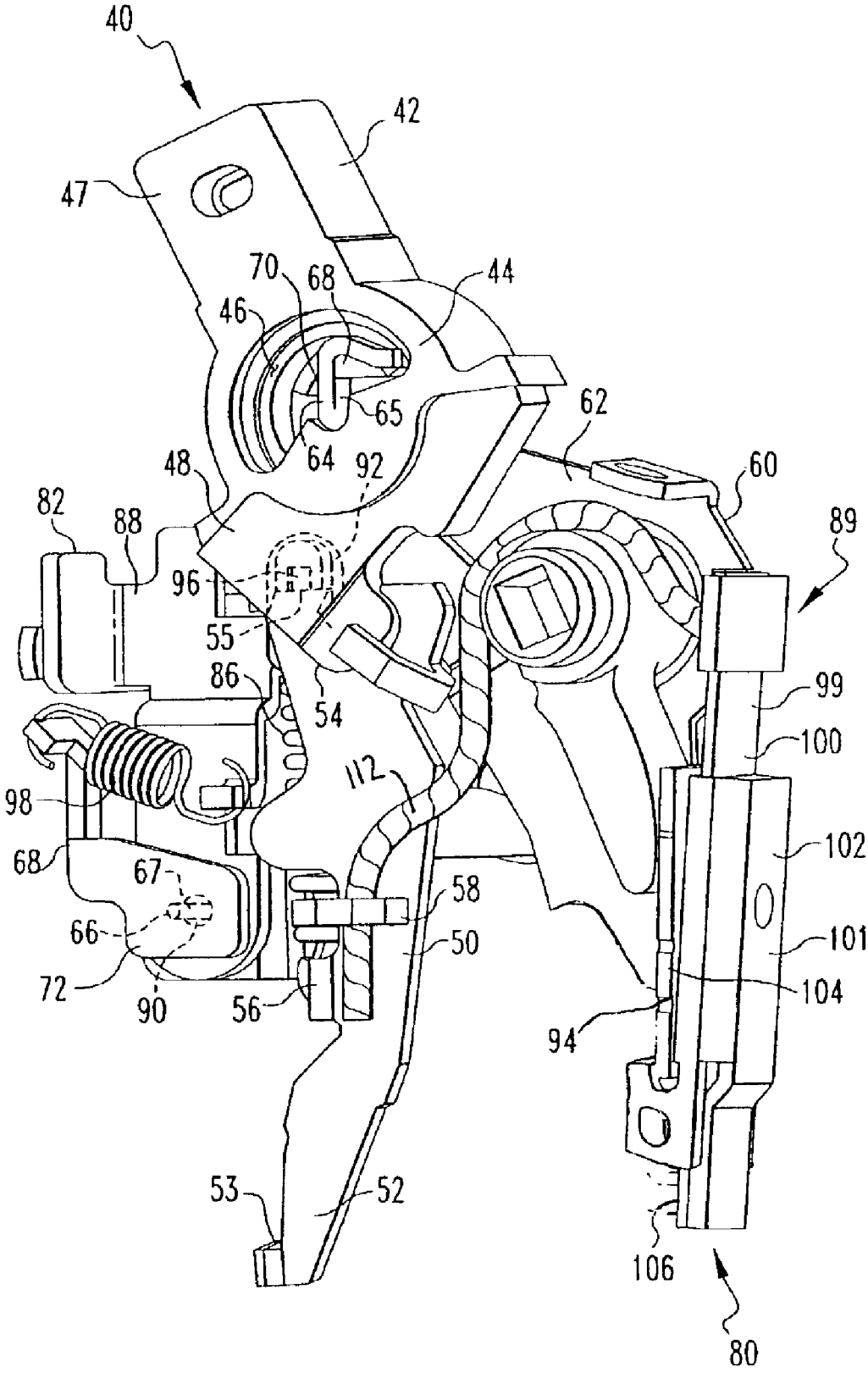
FIG. 2 is a isometric view of the unitary operating mechanism.
Figure 3:
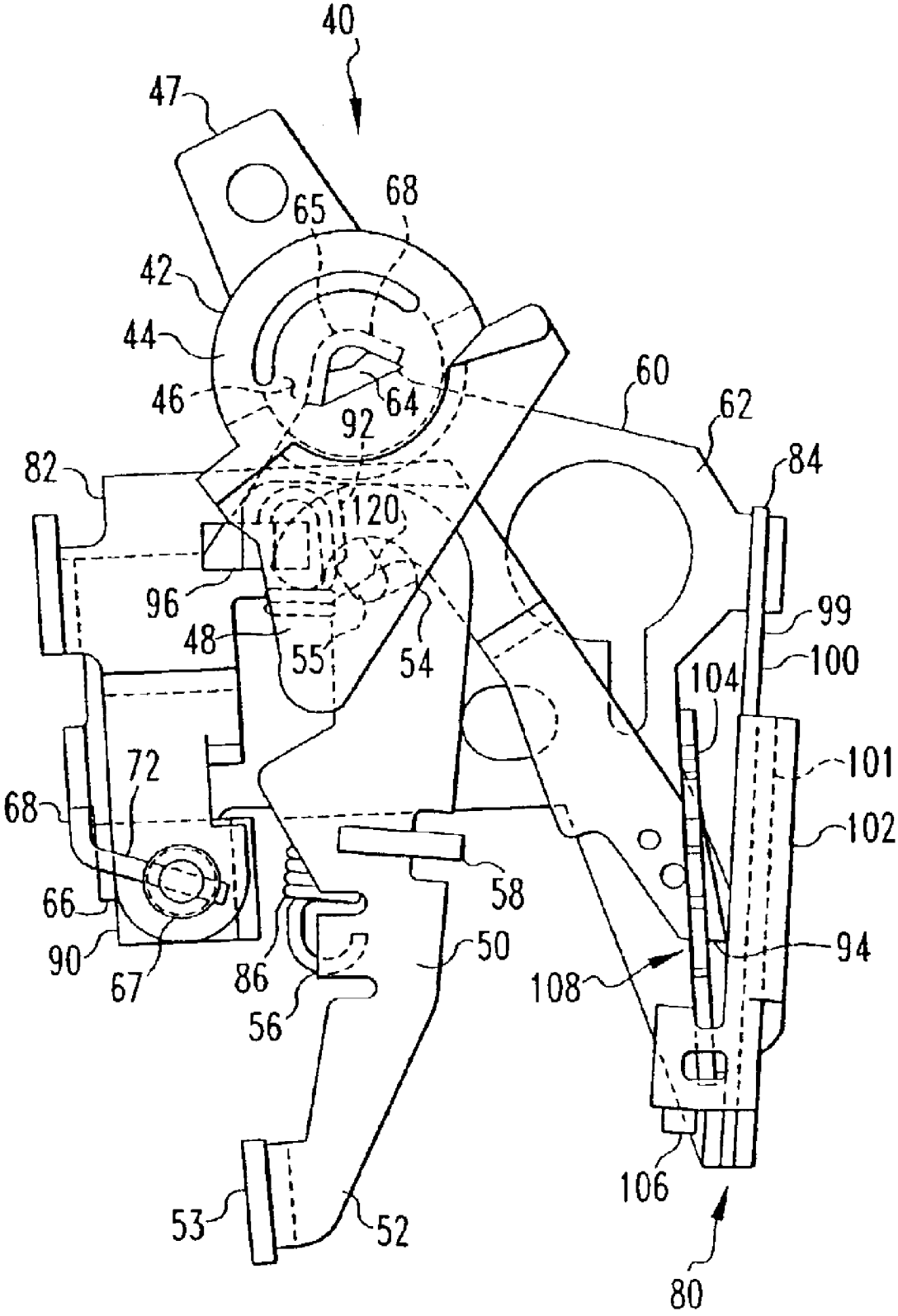
FIG. 3 is an side view of the unitary operating mechanism.

The unitary operating mechanism assembly 40, shown in FIGS. 1–3, includes a handle member 42, an operating arm 50, a frame assembly 60, and a trip device 80. The handle member 42 includes a generally circular portion 44 having a central opening 46, an elongated, radial extension 47 that extends out of the housing 12, and an operating arm tab 48. The handle member 42 is made from a non-conductive material. The operating arm 50 includes a contact end 52 that forms the movable contact 53, a handle member engaging end 54 having a notch 55, a spring tab 56 and a conductor bracket 58. The operating arm 50 is preferably made from a conductive metal, such as copper or brass.

The frame assembly 60 includes a generally planar member 62 which has a first pivot point 64 and a second pivot point 66. At each pivot point 64, 66 there is an elongated member, a first elongated member 65 at the first pivot point 64 and a second elongated member 67 at the second pivot point 66. The elongated members 65, 67 act as axles as described below. At each pivot point 64, 66 is an associated capture device 68. The capture device is structured to capture a component rotatably disposed on the elongated members 65, 67. The capture device 68 at the first pivot point 64 is preferably a bendable portion 70 at the distal end of the first elongated member 65 that is structured to be bent at about a right angle relative to the axis of the first elongated member 65. The capture device 68 at the second pivot point 66 is preferably an L-shaped tab 72 extending from the planar member 62. The L-shaped tab 72 is also bendable and may be initially manufactured as a plate extending perpendicular to the planar member 62. During manufacture, after a component has been disposed on the second elongated member 67, the plate is bent to have an L-shape with the distal end of the plate over the elongated member 67. The frame assembly 60 is preferably made from a malleable metal, such as steel.

The trip device 80 includes a cradle 82 and a trip assembly 84 and a trip spring 86. The cradle 82 includes a generally planar member 88 having a pivot opening 90, a handle contact point 92 and a latch ledge 94 (FIG. 2). The cradle planar member 88 is structured to be rotatably coupled to the frame assembly 60 at the second pivot point 66 by the pivot opening 90. The latch ledge 94 is latched by the trip assembly 84, which will be described in more detail below. The trip spring 86 is an over center spring connected, under tension, at one end to the operating arm spring tab 56 near the lower end of the operating arm contact end 52, and at the other end thereof to a trip spring projection 96 extending from the cradle planar member 88. There may be an additional cradle planar member spring 98 extending between the cradle planar member 88 and the frame assembly 60. The cradle planar member spring 98 is preferably a tension spring disposed adjacent to the second pivot point and structured to bias the cradle planar member to the second, open position, described below.

The trip assembly 84 includes a thermal trip device 99 which responds to persistent low level overcurrents and a magnetic trip device 101 which responds instantaneously to higher overload currents. The thermal trip device 99 includes the bimetal member 100. The magnetic trip device 101 includes a magnetic yoke 102 and a magnetic armature 104. The bimetal member 100 is coupled at one end to the frame assembly 60. The magnetic yoke 102 is a generally U-shaped member secured to the bimetal member 100 at the bight portion of the magnetic yoke 102 with the legs thereof facing the armature 104. The magnetic armature 104 is secured to a supporting spring 106 that is in turn secured to the bimetal member 100. Thus, the armature 104 is supported on the bimetal member 100 by the spring 106. The armature 104 has an opening 108 through which the latch ledge 94 on the cradle planar member 88 extends, thereby engaging the edge of the opening 108. This acts to latch the unitary operating mechanism 40 in the first, closed position, as shown in FIG. 1 and as described below. A first flexible conductor 110 is secured at one end to the proximal end of the bimetal member 100 and at the other end to the second terminal contact pad 30. A second flexible conductor 112 is secured at one end to the distal end of the bimetal member 100 and at the other end thereof to the operating arm conductor bracket 58. Thus, the operating arm 50 is electrically coupled with the bimetal member 100.

The unitary operating mechanism assembly 40 is assembled as follows. The cradle planar member 88 is rotatably coupled to the frame assembly 60 at the second pivot point 66 by passing the second elongated member 67 through the pivot opening 90. The capture device 68 is used to secure the cradle planar member 88 to the frame assembly 60. That is, the L-shaped tab 72 is bent so that the distal end of the L-shaped tab 72 is over the distal end of the second elongated member 67. The latch edge 94 on the cradle planar member 88 is disposed adjacent to the trip assembly 84. The handle member 42 is then rotatably coupled to the frame assembly 60 at the first pivot point 64 by passing the first elongated member 65 through the handle member central opening 46. The capture device 68 is used to secure the handle member 42 to the frame assembly 60. That is, the bendable portion 70 is bent so that the handle member 42 cannot be removed from the first elongated member 65. The handle member 42 contacts the cradle planar member 88 at the handle contact point 92. The operating arm 50 is coupled to the handle member 42 by disposing the handle member operating arm tab 48 in the operating arm notch 55 and coupling the trip spring 86, under tension, at one end to the operating arm spring tab 56, and at the other end thereof to the trip spring projection 96 extending from the cradle planar member 88. The tension provided by the trip spring 86 biases the operating arm 50 against the handle member 42 with enough force to maintain the operating arm 50 in position. The interaction between the operating arm notch 55 and the handle member operating arm tab 48 defines an operating arm pivot point 120. The operating arm 50 is also coupled to the bimetal member 100 by attaching the second flexible conductor 112 at one end to the bimetal member 100 and at the other end thereof to the operating arm conductor bracket 58.

In this configuration the unitary operating mechanism assembly 40 is structured to move the operating arm 50 between a first, closed position and a second, open position. The cradle planar member 88 is structured to be moved from a first, latched position, where the latch ledge 94 on the cradle planar member 88 engages the edge of the trip armature opening 108, to a second, unlatched position, where the latch ledge 94 on the cradle planar member 88 does not engage the edge of the trip armature opening 108. The handle member 42 is structured to move between a first, closed position, an intermediate tripped position, a second, open position, and a third, reset position. When the cradle planar member 88 is in the first, latched position, moving the handle member 42 between the first, closed position and the second, open position causes a corresponding motion in the operating arm 50. That is, when the cradle planar member 88 is in the first, latched position, moving the handle member 42 between the first, closed position and the second, open position causes the operating arm 50 to move between the first, closed position and the second, open position. As described below, this action acts to manually open the circuit breaker 10. Moving the handle member 42 to the reset position while the cradle planar member 88 is in the first, latched position has, essentially, no effect. When the cradle planar member 88 is in the second, unlatched position, moving the handle member 42 to the reset position causes the cradle planar member 88 to move into the first, latched position. When the cradle planar member 88 is in the second, unlatched position, moving the handle member 42 from the intermediate or second, open position to the first closed position has, essentially, no effect.

When the cradle planar member 88 is in the second, unlatched position, the trip spring projection 96 coupled to the trip spring 86 is to the right, as shown in FIGS. 1–3, of an imaginary line between the operating arm notch 55 and the operating arm contact end 52. When the cradle planar member 88 is in the first, latched position, the trip spring projection 96 coupled to the trip spring 86 is to the left, as shown in FIGS. 1–3, of an imaginary line between the operating arm notch 55 and the operating arm contact end 52. Thus, when the cradle planar member 88 is in the second, unlatched position, the trip spring 86 moves the operating arm to the second, open position. When the cradle planar member 88 is in the first, latched position, the operating arm may be moved by handle member 42 into either the first, closed position or the second, open position. Because the components of the unitary operating mechanism assembly 40 are coupled and secured to each other, the unitary operating mechanism assembly 40 may perform the motions described above while disposed outside of a circuit breaker housing 12. That is, unlike the prior art, no component of the unitary operating mechanism assembly 40 pivots on the circuit breaker housing 12 and no component, other than the frame assembly 60, is attached to the housing 12.

To assemble the circuit breaker 10, the unitary operating mechanism assembly 40 is disposed in the operating mechanism cavity 22. The unitary operating mechanism assembly 40 may be coupled to the circuit breaker housing 12 by any common means such as, but not limited to, a fastener or glue. The first flexible conductor 110 is secured at one end to the proximal end of the bimetal member 100 and at the other end to the second terminal contact pad 30. The operating arm contact end 52 is disposed adjacent to the fixed contact 28. When the operating arm 50 is in the first, closed position, the movable contact 53 and the fixed contact 28 are in electrical communication. When the operating arm 50 is in the second, open position, the movable contact 53 and the fixed contact 28 are separated. Thus, when the operating arm 50 is in the first, closed position, there is a first electrical circuit through the circuit breaker 10 extending from the first terminal conductor 14, through the fixed contact 28, the movable contact 53, the operating arm 50, the second flexible conductor 112, the bimetal member 100, the first flexible conductor 110, the contact pad 30, and the second terminal conductor 16.

With the circuit breaker 10 is in the first, closed position shown in FIG. 1, a persistent overload current of a predetermined value causes the bimetal member 100 to become heated and deflect to the right, as viewed in the figures, to effect a time delayed thermal tripping operation. The armature 104, which is supported on the bimetal member 100 by means of the leaf spring 106, is carried to the right with the bimetal member 100 to release the cradle 82. When the cradle 82 is released, the trip spring 86 rotates the cradle clockwise about the second pivot point 66. During this movement, the line of action of the trip spring 86 moves to the right of the point at which the operating arm 50 is pivoted about the operating arm notch 55 to rotate the operating arm 50 counterclockwise to snap the fixed and movable contacts 28, 53 open. In addition, the handle member 42 is rotated to position the handle member radial extension 47, which is visible outside of the circuit breaker housing 12, to the intermediate position between the first, closed and second, open positions thereby providing a visual indication that the circuit breaker 10 has tripped open.

Before the contacts 28, 53 can be closed following an automatic tripping operation, it is necessary to reset and relatch the unitary operating mechanism assembly 40. This is accomplished by moving the handle member 42 clockwise from the intermediate position to the third, reset position which is slightly beyond the second, open position to relatch the cradle 82. During this movement, due to the engagement of the cradle 82 by the handle member 42 at the handle contact point 92, the cradle 82 is moved counterclockwise about the second pivot point 66 until the latch ledge 94 of the cradle 82 is again latched in the opening 108 of the armature 104. The handle member 42 may then be moved in a counterclockwise direction to the first, closed position shown in FIG. 1. This action moves the upper end of the operating arm 50 to the right of the line of action of the trip spring 86 to close the contacts 28, 53.

The circuit breaker 10 is magnetically tripped automatically, and instantaneously, in response to overload currents above a second predetermined value higher than the predetermined value for the thermal trip. Flow of overload current above this higher predetermined value through the bimetal member 100 induces magnetic flux around the bimetal member 100. This flux is concentrated by the magnetic yoke 102 toward the armature 104. An overload current above the second predetermined value generates a magnetic force of such a strength that the armature 104 is attracted toward the magnetic yoke 102 resulting in the flexing of the spring 106 permitting the armature 104 to move to the right to release the cradle 82 and trip the circuit breaker 10 open in the same manner as described with regard to thermal tripping operation. Following a magnetic trip operation, the circuit breaker 10 is reset and relatched in the same manner as described above.

The handle member 42 may be used to manually open and close the contacts 28, 53. More specifically, when going from the first, closed position to the second, open position, the handle member 42 is moved in a clockwise direction from the handle position as shown in FIG. 1. Due to the tension which exists in trip spring 86 to maintain the contacts 28, 53 in the closed position, a sufficient amount of force must be applied to the handle member 42 so as to overcome the tension in the trip spring 86 and allow the handle member 42 to move in a clockwise direction. As the force is applied and handle member 42 begins to move in the clockwise direction, the upper end of operating arm 50 also begins to move in a counterclockwise direction as a result of the driving connection provided between the handle member 42 and the operating arm notch 55. This cooperation defines the operating arm pivot point 120 about which the operating arm 50 is pivoted on the handle member 42 to rotate the operating arm 50. During the described counterclockwise movement of the upper end of operating arm 50, the lower end of operating arm 50 begins to move in a counterclockwise direction as well, i.e. the movable contact 53 which is mounted on the operating arm 50 begins to move in a counterclockwise direction away from fixed contact 28. The lower end of trip spring 86 is also carried in a counterclockwise direction along with the lower end of operating arm 50 due to the spring 86 being connected to spring tab 56 which is located at the lower end of the operating arm 50.

It should be appreciated that the sequence of events described thus far result from a sufficient amount of force being applied to handle member 42 so as to overcome the tension in the trip spring 86. Then, once a sufficient amount of force has been applied to move the line of action of trip spring 86 to the right of the operating arm pivot point 120, i.e. over center, about which operating arm 50 is pivoted on, the amount of tension in the spring begins to decrease, thus carrying the line of action of the trip spring 86 even further to the right in a counterclockwise direction until finally coming to rest along a second line of action. Of course, the lower end of operating arm 50 also continues to move in a counterclockwise direction as a result of operating arm spring tab 56 being connected to the trip spring 86. Once the trip spring 86 reaches the second line of action and comes to rest, the operating arm 50 also comes to rest. More specifically, once the operating arm 50 comes to rest, the contacts 28, 53 are in the second, open position and the handle member 42 is in the second, open position as well.

Once the trip spring 86 moves to the right of the operating arm pivot point 120, i.e. over center, then no additional force needs to be manually applied to handle member 42 in order for the handle member 42 to continue to move from the first, closed position to the second, open position; the trip spring 86 becomes the driving force for moving the handle member 42 to the second, open position as a result of the spring moving to the right of the pivot point and continuing to the right as the tension decreases in the trip spring 86. This, in turn, results in continued movement of the lower end of operating arm 50 in the counterclockwise direction which results in the upper end of the operating arm 50 also moving in a counterclockwise direction and driving the radial extension 47 of handle member 42 in a clockwise direction until the radial extension 47 reaches the second, open position. The driving force for moving handle member 42 is thus provided by the operating arm notch 55 pushing against operating arm tab 48. This pushing action between the operating arm notch 55 and operating arm tab 48 is caused by the trip spring 86 moving to the right causing the lower end of the operating arm 50 to move in a counterclockwise direction and forcing the upper end of the operating arm in a counterclockwise direction and so on, as previously described.

Figure 4:
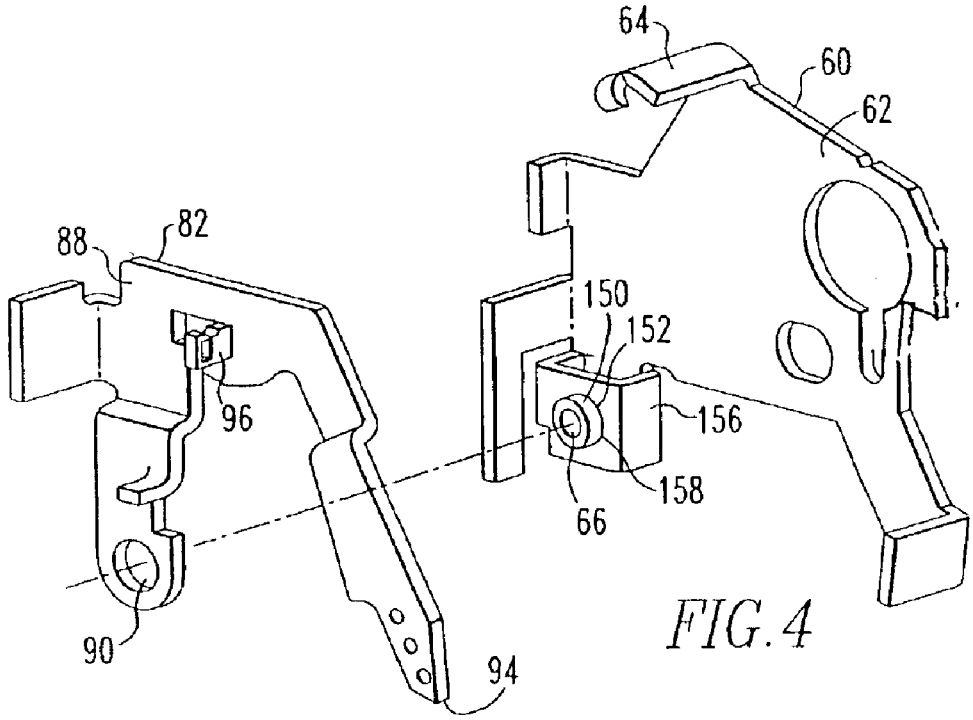
FIG. 4 is an exploded isometric view of the frame assembly and cradle.
Figure 5:
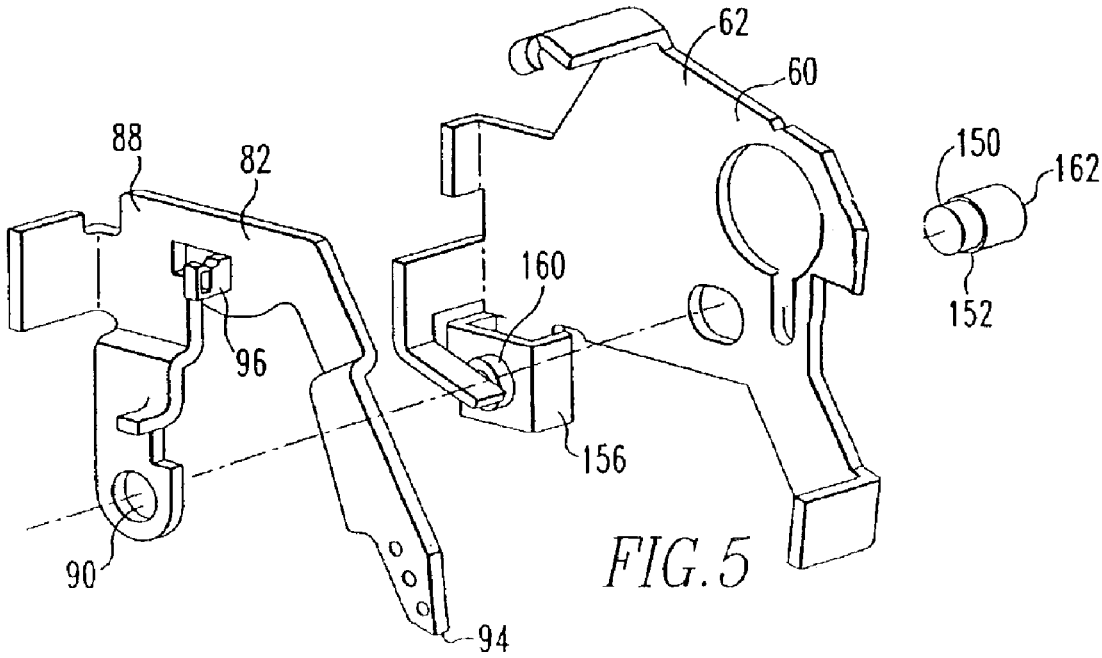
FIG. 5 an exploded isometric view of an alternate frame assembly and cradle.

An additional advantage of the unitary operating mechanism assembly 40 is that the structures at the first and second pivot points 64, 66 may be constructed of metal. That is, there is a metal pivot structure 150 at the first and second pivot points 64, 66. The metal pivot structure 150 may be a simple member 65, 67 as discussed above, however, in a preferred embodiment, as shown in FIG. 4 the metal pivot structure 150 at the second pivot point 66 is a shoulder 152 extending from the frame assembly 60. The cradle planar member 88 includes a pivot opening 90 that is structured to engage the shoulder 152. Thus, the cradle planar member 88 is pivotally coupled to the frame assembly 60. The frame assembly 60 may further include a cradle pivot tab 156 upon which the shoulder 152 is disposed. The shoulder 152 may be an extruded disk 158 which is integral to the frame assembly 60. Alternatively, as shown in FIG. 5, the frame assembly 60, or, more specifically, the cradle pivot tab 156, may have an opening 160 and the shoulder 152 is formed by a shoulder pin 162 extending through the cradle pivot tab opening 160. While the use of the metal pivot structure 150 is easily integrated into the unitary operating mechanism 40, the metal pivot structure 150 may also be advantageously used with non-unitary operating mechanisms, such as those known in the prior art.

Because the cradle planar member 88, which is typically made from metal, is coupled to a metal pivot structure 150 on the frame assembly 60, and because the trip spring 86 extending between the operating arm 50 and the cradle planar member 88 is typically metal, there exists a second electrical circuit through the unitary operating mechanism assembly 40. That is, when the operating arm 50 is in the first, closed position, there is a second electrical circuit through the circuit breaker 10 extending from the first terminal conductor 14, through the fixed contact 28, the movable contact 53, the operating arm 50, the trip spring 86, the cradle planar member 88, the frame assembly 60, the first flexible conductor 110, the contact pad 30, and the second terminal conductor 16. Because the second conductor 112 is typically copper, electricity is more likely to flow through the first electrical circuit described above. A small amount of electricity, however, may leak through the second electrical circuit and bypass the trip assembly 84.

Figure 6:
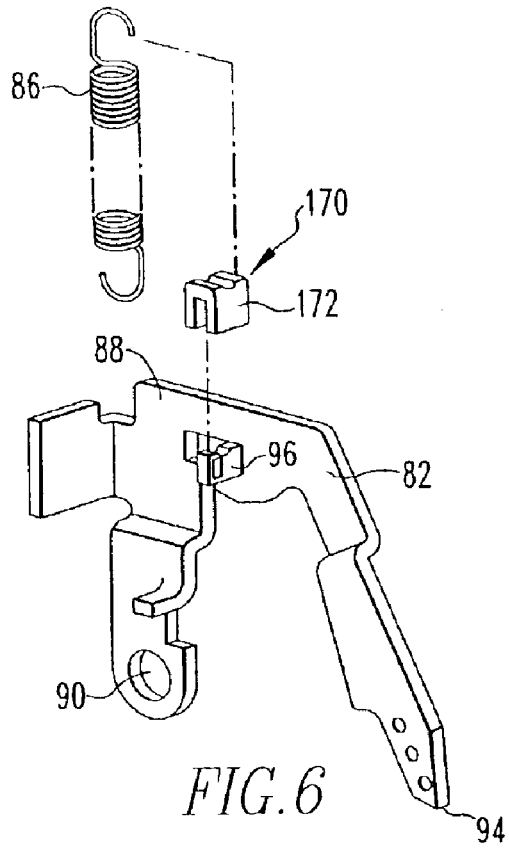
FIG. 6 is an isometric view of a cadle with a non-conductive bushing.
Figure 7:
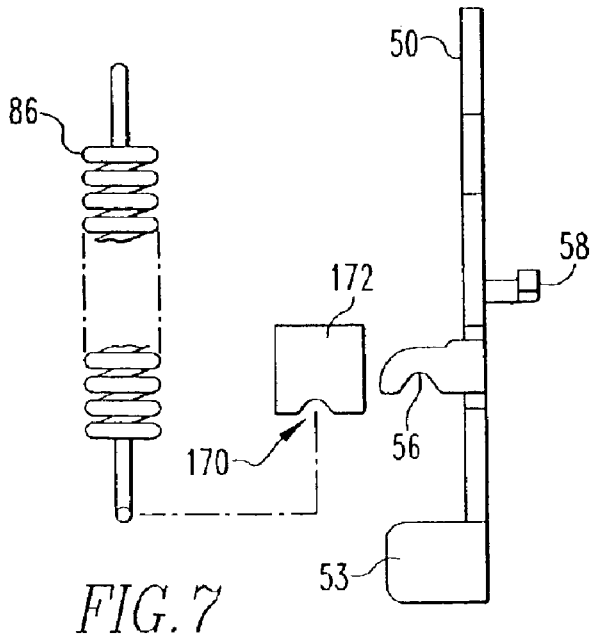
FIG. 7 is an isometric view of an operating arm with a non-conductive bushing.

As shown in FIG. 6, the unitary operating mechanism assembly 40 may also include a non-conductive barrier 170 coupled to one, or both, ends of the trip spring 86. In the preferred embodiment, the non-conductive barrier 170 is a bushing 172 disposed on the cradle trip spring projection 96. The bushing 172 is made from a material such as a phenolic, plastic, a ceramic, or rubber. Alternatively, as shown in FIG. 7, the non-conductive barrier 170 is a bushing 172 disposed on the operating arm spring tab 56. As another alternative, the non-conductive barrier 170 may be incorporated into the trip spring 86. That is, the trip spring 86 may be made from a non-conductive material. So long as electricity cannot flow through the trip spring 86, the second circuit will not exist. The non-conductive barrier 170 may also be advantageously used with non-unitary operating mechanisms, such as those known in the prior art, where, if the cradle and frame contact each other, a second circuit could be formed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An operating mechanism assembly for a miniature circuit breaker comprising:

a frame assembly;

a trip device having a cradle member structured to pivot about a pivot point and a trip assembly, said trip assembly coupled to said frame assembly;

a metal pivot structure coupled to said frame assembly; and said cradle member pivotally disposed on said metal pivot structure.

2. The operating mechanism assembly of claim 1, wherein:

said metal pivot structure is a circular metal shoulder extending from said frame assembly; and said cradle member has a pivot opening structured to engage said shoulder.

3. The operating mechanism assembly of claim 2, wherein said metal shoulder is an extruded disk disposed on said frame assembly.

4. The operating mechanism assembly of claim 2, wherein said frame assembly includes a cradle pivot tab and said shoulder is disposed on said cradle pivot tab.

5. The operating mechanism assembly of claim 2, wherein said frame assembly has an opening and a shoulder pin; and said shoulder is formed by said shoulder pin extending through said opening.

6. The operating mechanism assembly of claim 5, wherein said frame assembly includes a cradle pivot tab and said shoulder is disposed on said cradle pivot tab.

7. A miniature circuit breaker comprising:

a non-conductive housing defining an operating mechanism cavity;

a first terminal conductor and a second terminal conductor;

said first terminal conductor and second terminal conductor coupled to said housing assembly external to said operating mechanism cavity and having conductive tabs extending into said operating mechanism cavity;

at least one pair of separable contacts disposed in said operating mechanism cavity and having a fixed contact and a movable contact structured to move between a first, closed position and a second, open position, said fixed contact coupled to said first terminal conductor and said movable contact coupled to said second terminal;

an operating mechanism assembly disposed in said operating mechanism cavity and structured to move said contacts between said first, closed position and said second, open position; and said operating mechanism assembly having a frame assembly, a trip device having a cradle member structured to pivot about a pivot point and a trip assembly, said trip assembly coupled to said frame assembly, a metal pivot structure coupled to said frame assembly, and wherein said cradle member pivotally is disposed on said metal pivot structure.

8. The miniature circuit breaker of claim 7, wherein:

said metal pivot structure is a circular metal shoulder extending from said frame assembly; and said cradle member has a pivot opening structured to engage said shoulder.

9. The miniature circuit breaker of claim 8, wherein said metal shoulder is an extruded disk disposed on said frame assembly.

10. The miniature circuit breaker of claim 8, wherein said frame assembly includes a cradle pivot tab and said shoulder is disposed on said cradle pivot tab.

11. The miniature circuit breaker of claim 8, wherein said frame assembly has an opening and a shoulder pin; and said shoulder is formed by said shoulder pin extending through said opening.

12. The miniature circuit breaker of claim 11, wherein said frame assembly includes a cradle pivot tab and said shoulder is disposed on said cradle pivot tab.

* * * * *